US011105582B1

(12) United States Patent
Spuhr

(10) Patent No.: US 11,105,582 B1
(45) Date of Patent: Aug. 31, 2021

(54) ADJUSTABLE BUTTSTOCK FOR FIREARM

(71) Applicant: SPUHR I DALBY AB, Löddeköpinge (SE)

(72) Inventor: Håkan Spuhr, Dalby (SE)

(73) Assignee: SPUHR I DALBY AB, Löddeköpinge (SE)

( * ) Notice: Subject to any disclaimer, the term of this patent is extended or adjusted under 35 U.S.C. 154(b) by 0 days.

(21) Appl. No.: 16/911,207

(22) Filed: Jun. 24, 2020

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/14; F41C 23/04; F41C 23/20; F41C 23/06; F41C 23/22; F41A 3/84
USPC ..... 42/71.01–75.1
See application file for complete search history.

(56) References Cited

U.S. PATENT DOCUMENTS 4,282,671 A * 8/1981 Wood ..... F41C 23/16 42/75.01
5,001,855 A * 3/1991 Griggs ..... F41C 23/08 42/74
5,410,815 A * 5/1995 Parikh ..... F41G 3/2655 42/115
5,979,098 A * 11/1999 Griggs ..... F41C 33/06 42/73
7,762,018 B1 * 7/2010 Fitzpatrick ..... F41C 23/22 42/73
9,534,866 B1 * 1/2017 Gianakos ..... F41B 13/00
9,726,444 B1 * 8/2017 Sisk ..... F41C 23/14
2006/0242880 A1 * 11/2006 Griffin ..... F41C 23/04 42/73
2010/0180484 A1 * 7/2010 Aalto ..... F41A 35/06 42/73
2015/0052795 A1 * 2/2015 Burke ..... F41C 23/14 42/71.01
2016/0010944 A1 * 1/2016 Downey ..... F41C 23/06 42/74
2016/0153742 A1 * 6/2016 Copeland ..... F41C 27/04 42/72
2016/0187087 A1 * 6/2016 Olsen ..... F41A 3/66 42/75.03
2016/0363412 A1 * 12/2016 EuDaly ..... F41B 7/003
2018/0066916 A1 * 3/2018 Olsen ..... F41C 23/14
2018/0202755 A1 * 7/2018 Gaudet ..... F41C 23/08
2020/0109912 A1 * 4/2020 Parra ..... F41C 23/16
2020/0232752 A1 * 7/2020 Rotharmel ..... F41C 23/04
2021/0048274 A1 * 2/2021 Hopkins ..... F41C 23/14

* cited by examiner

*Primary Examiner* — Michael D David
(74) *Attorney, Agent, or Firm* — Klein, O'Neill & Singh, LLP

(57) ABSTRACT

An adjustable buttstock has a front part configured to be attached to a firearm, and a rear part forming a prismatic joint with the front part. The prismatic joint has an adjustment axis and allows the rear part to slide relative to the front part along the adjustment axis. The buttstock further has a lock assembly that includes a wedge. The buttstock has a locked state in which the wedge is releasably wedged between the front part and the rear part, preventing a radial play between the front part and the rear part, and an unlocked state in which the wedge is unengaged with respect to the prismatic joint, allowing radial play between the front part and the rear part.

20 Claims, 8 Drawing Sheets

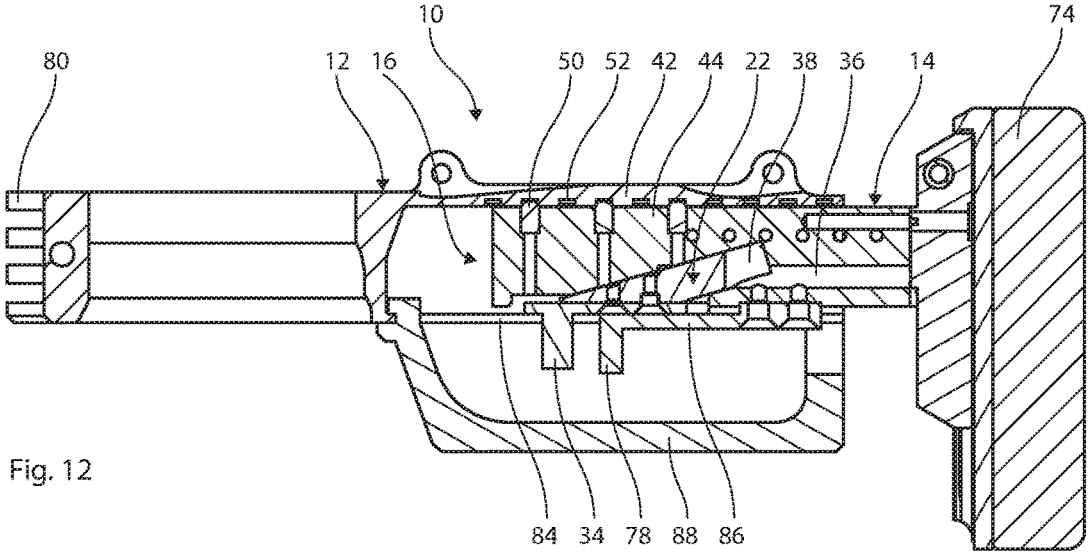
Fig. 12
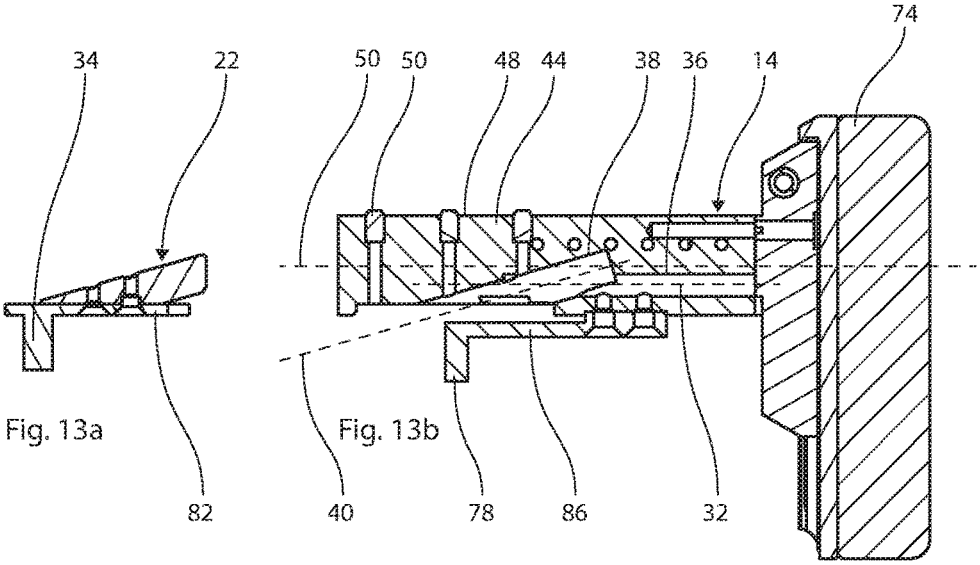
Fig. 13a
Fig. 13b
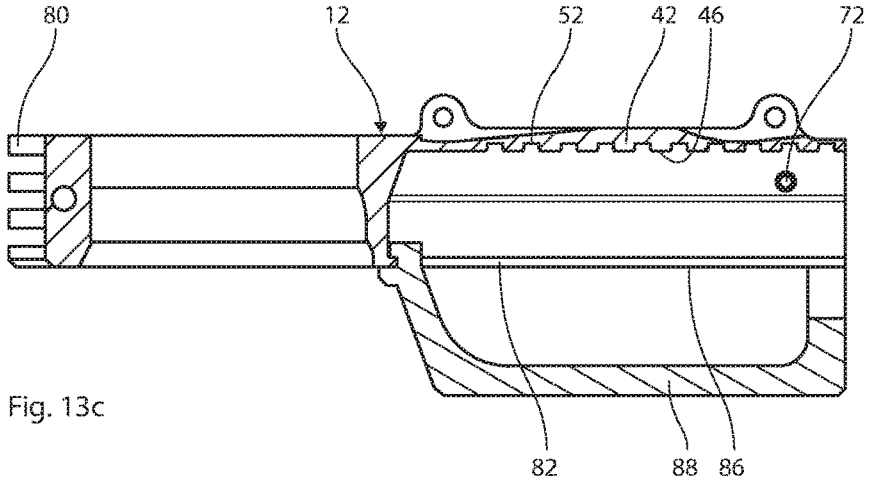
Fig. 13c

ADJUSTABLE BUTTSTOCK FOR FIREARM

CROSS REFERENCE TO RELATED APPLICATIONS

Not Applicable

FEDERALLY SPONSORED RESEARCH OR DEVELOPMENT

Not Applicable

TECHNICAL FIELD

The proposed technology relates generally to buttstocks for firearms. It relates specifically to adjustable buttstocks having a rear part that can be adjusted relative to a front part. It further relates to buttstocks that can be used on long guns.

BACKGROUND

A buttstock, or shoulder stock, is the back portion of a firearm, or a chassis of a firearm. A shooter holds the buttstock against the shoulder to improve the stability of the firearm when aiming and to better handle recoil when shooting. Length-adjustable buttstocks are known to be used on rifles for military, law enforcement, and civilian use. They are also mounted on submachine guns, typically for military or law enforcement use. The typical advantage of the length-adjustable buttstock is a weapon that can be adjusted to the preferences of a shooter.

The optimal buttstock length depends on shooting position. For example, many shooters prefer a longer buttstock when shooting from a prone position than when shooting from a kneeling or standing position. There are many situations in which quick changes between shooting positions are required, for example in field operations and certain competition matches. It is therefore desirable that the length of the buttstock can be swiftly adjusted. This requires a locking mechanism that can be engaged and disengaged quickly, and that can be accessed and operated with the buttstock resting against the shoulder of the shooter.

An adjustable buttstock typically has a front part that is attached to the firearm and a rear part that can be shifted relative to the front part. The structural stability of buttstock may influence the accuracy and precision when shooting. For example, there may be some play between the front part and the rear part of an adjustable buttstock that negatively influences the consistency in handling, which in extension can negatively affect the accuracy and precision. It is therefore desirable to have an adjustable buttstock that is structurally stable and provides a consistent shoulder support.

Another problem with play between a front part and a rear part is that it can cause the buttstock to rattle when handled. Such noise can be detrimental in field operations, revealing the position of an operator.

SUMMARY

The proposed technology aims at improving the performance of adjustable buttstocks, in particular with respect to usability and structural stability. It further aims at obviating the aforementioned disadvantages of known adjustable buttstocks, and at providing a buttstock without play between a front part and a rear part. It is a specific object of the proposed technology to improve the handling, for example with respect to consistency, ease of use, and the time it takes to adjust the buttstock.

According to a first aspect of the proposed technology, one or more of the above objects are achieved by an adjustable, or collapsible, telescoping, or length-adjustable, buttstock for a firearm. In accordance with this aspect, the buttstock may comprise a buttstock front part, or buttstock support part, configured to be attached to, or supported by, the firearm, or a rear end of a receiver, or chassis, of the firearm. The buttstock may further comprise a buttstock rear part, or buttstock adjustable part, forming a prismatic joint, linear joint, or slider, with the front part. The prismatic joint has, or defines, an adjustment axis, and it allows, or is configured to allow, the rear part to slide relative to the front part along the adjustment axis. The buttstock may further comprise a lock assembly comprising a wedge. The adjustable buttstock, or the lock assembly, has, or can be set in, a locked state in which the wedge is wedged, or releasably wedged, between the front part and the rear part at the prismatic joint for, or thereby, preventing or reducing a radial or transverse play between the front part and the rear part relative to the adjustment axis. The adjustable buttstock, or the lock assembly, further has, or can be set in, an unlocked, or open, state in which the wedge is unengaged with respect to the prismatic joint for, or thereby, allowing for a radial play between the front part and the rear part relative to the adjustment axis.

According to a second aspect of the proposed technology, a firearm comprising an adjustable buttstock according to the first aspect of the proposed technology is provided.

The adjustable buttstock may be a buttstock for a long gun, such as a sniper rifle, long range precision rifle, or hunting rifle. The long gun may be an "automatic" rifle, which, for the purpose of this disclosure, encompasses both semi-automatic and fully automatic rifles. The adjustable buttstock may be used on machineguns, submachineguns, and shotguns. The sliding of the rear part relative to the front part allows for the length of the buttstock to be adjusted, effectively meaning that the buttstock is length-adjustable. The adjustable buttstock may be configured to be attached to a firearm with the adjustment axis parallel with the bore axis, or bore line, of the firearm. The buttstock and the firearm may have a straight-line recoil configuration in which the center-of-gravity of the firearm with the adjustable buttstock attached is at, or close to, the bore axis.

A wedge is to be understood as a structural part having the function of a wedge to hold objects in place. The term is not to be construed as limited to a specific geometrical shape, such as a triangular shaped tool. The shifting of a wedge is a simple and reliable mechanical operation, which means that a quick change between the locked and unlocked states is possible. In extension, this allows for quick adjustment of the rear part relative to the front part.

A prismatic joint is understood as a joint providing a linear sliding movement between two bodies or elements. The prismatic joint may form part of the lock assembly. The wedge, the front part, and the rear part may form a radial lock.

Radial play relative to an axis is here understood to encompass play that is transverse to the axis. It is understood that the front part and the rear part constitute a one degree of freedom kinematic pair, disregarding the radial play in the unlocked state. In the locked state, the shape or form of the wedge may conform to the front part and the rear part.

Further optional technical details of the different aspects of the proposed technology are described below.

The front part and the rear part of the buttstock may be of metal and/or a metal alloy, such as an aluminum alloy. Additionally, the wedge may be of metal and/or a metal alloy, such as an aluminum alloy. The contact surfaces between the front part, the rear part, and the wedge in the prismatic joint may be metal-to-metal.

The front part and the rear part may each be a rigid structure. Additionally, the wedge may be a rigid structure. This contributes to a stiffer structure with an improved ability to withstand bending and torsion, which in extension contributes an improved precision and accuracy when shooting.

The rigid structure may be a unitary body. A unitary body is here understood to encompass a body that is composed of a single piece. It may be formed as a single unit or piece, for example by welding two pieces together, by machining a single piece of material, by molding, and/or by using additive technologies such as 3D printing, leaving a single part which cannot be disassembled into smaller components.

The wedge may be configured to move along a wedge axis that is coplanar with and intersects the adjustment axis. The wedge axis may define an angle ($\alpha$), or tip angle, with respect to the adjustment axis. The angle ($\alpha$) may be in the range 10° to 20°, 10° to 30°, 15° to 20°, 15° to 30°, 20° to 30°, or 30° to 45°. It is contemplated that the lower angular intervals are preferable for higher strength aluminum alloys, while the higher angular intervals are preferable for lower strength aluminum alloys.

The lock assembly may comprise a spring configured to push the wedge along the wedge axis. The wedge may provide a mechanical advantage for the spring in the range 2.5 to 6 with respect to the front part and the rear part. The spring may be a coil spring having a helical axis, and the coil spring may be oriented with the helical axis parallel with the adjustment axis. This means the wedge axis may define the same angle to the helical axis as to the adjustment axis. Thus, the coil spring may slide on the wedge when the buttstock changes between locked and unlocked states. This has the advantage of a more compact construction transversely to the adjustment axis.

The spring may be configured to bias the wedge to set the adjustable buttstock, or the lock assembly, in the locked state. For example, the spring may be a compression spring oriented to push the tip of the wedge between the front part and the rear part. The lock assembly may comprise a first grip, or a wedge grip, fixed to, or formed by, the wedge and configured for a manual setting of the adjustable buttstock, or the lock assembly, in the unlocked state by an operator. The first grip allows for the biasing of the spring to be manually counteracted. The first grip may have the form of a lever or bar that is fixed to the wedge. The first grip may be a finger grip configured to be operated using one or more fingers.

The rear part may comprise, or form, a wedge support, or wedge housing, slidably supporting, or configured to slidably support, the wedge, and optionally a spring support, or spring housing, supporting, or configured to support, the spring. The rear part may comprise, or form, a second grip, or rear part grip, adapted for a manual shifting of the position of the rear part relative to the front part by an operator. The second grip may be a finger grip configured to be operated using one or more fingers.

The rear part may have a wedge retainer preventing the wedge from leaving the wedge support if the rear part is completely removed from the front part.

The first grip of the lock assembly may be located at the second grip and move towards the second grip when the adjustable buttstock, or the lock assembly, changes from the locked state to the unlocked state. This is particularly advantageous when the rear part comprises the wedge support, since then the distance between the second grip and the first grip does not depend on the position of the rear part. The operator can then change the state to unlocked by gripping both the first grip and the second grip and press them together with one hand and then shift the position of the rear part by pushing or pulling on the second grip with the same hand while maintaining the unlocked state. This way, the complete adjustment of the buttstock, including the unlocking and the shifting of rear part, can be made by a single pinching grip using the thumb and the index finger. This contributes to a faster and more distinct adjustment of the buttstock.

Alternatively, the front part instead of the rear part may comprise, or form, a wedge support, or wedge housing, that slidably supports the wedge, and optionally a spring support, or spring housing, that supports the spring. This has the effect that the wedge and the first grip can be located closer to the gun mechanisms, such as the firing trigger, that are engaged by the strong hand of the shooter, which allows for a faster engagement of the first grip.

The front part may have a wedge retainer preventing the wedge from leaving the wedge support if, or when, the rear part is completely removed from the front part.

The wedge support may define the wedge axis, for example by restricting the movement of the wedge to follow, or trace, the wedge axis. The wedge support may be connected to the spring support allowing the spring to bias the wedge. If the spring is a coil spring, the spring support may orient the spring with its helical axis parallel to the adjustment axis.

The wedge may be oriented, or configured, to further secure the wedge, or to further wedge between the front part and the rear part, if, or when, the front part and the rear part are pushed together along, or in the direction of, the adjustment axis in the locked state. Additionally, the wedge may be oriented, or configured, to release the wedge if, or when, the front part and the rear part are pulled apart along, or in the direction of, the adjustment axis in the locked state. These features have the effect that the recoil from shooting secures the buttstock, or the lock assembly, in the locked state.

Alternatively, the wedge may be oriented, or configured, to release the wedge if, or when, the front part and the rear part are pushed together along, or in the direction of, the adjustment axis in the locked state. Additionally, the wedge may be oriented, or configured, to further secure the wedge, or to further wedge between the front part and the rear part, if, or when, the front part and the rear part are pulled apart along, or in the direction of, the adjustment axis in the locked state. This prevents the rear part from wedging tight due to recoil, which allows for a more reliable operation. It is advantageously used together with other structures for transferring recoil from the front part to the rear part, as are described below.

In accordance with an aspect of the disclosure, the adjustable buttstock comprises, or forms, an axial lock preventing, or configured to prevent, a movement, or relative movement, between the front part and the rear part along the adjustment axis in the locked state, and for allowing, or configured to allow, a movement, or relative movement, between the front part and the rear part along the adjustment axis in the unlocked state.

The prismatic joint may comprise a front part engagement portion on the front part, and a rear part engagement portion on the rear part facing the front part engagement portion in the locked state, wherein the front part engagement portion and the rear part engagement portion are pressed together in the locked state. The front part engagement portion and the rear part engagement portion may be spaced apart, or separated, in the unlocked state. The front part engagement portion and the rear part engagement portion may form part of the axial lock.

The front part may comprise, or form, a front part joint portion, and the rear part may comprise, or form, a rear part joint portion, wherein the prismatic joint is formed by the front part joint portion and the rear part joint portion. The front part joint portion and the rear part joint portion constitute a one degree of freedom kinematic pair, disregarding any radial play in the unlocked state. The front part engagement portion may be located on the front part joint portion, and the rear part engagement portion may be located on the rear part joint portion.

In one alternative, the front part joint portion encloses, or surrounds, the rear part joint portion and the wedge. The rear part engagement portion may be positioned at radially, or transversely, opposing sides of the rear part joint portion with respect to the adjustment axis. Additionally, the front part joint portion and the rear part joint portion may be positioned at the same longitudinal, or lengthwise, position with respect to the adjustment axis.

In another alternative, the rear part joint portion encloses, or surrounds, the front part joint portion and the wedge, and the rear part joint portion may be positioned at radially, or transversely, opposing sides of the front part joint portion with respect to the adjustment axis.

The axial lock may define a plurality of discrete, or predetermined, relative positions between the front part and the rear part at which the locked state is possible, or at which the axial lock prevents the movement, or relative movement, between the front part and the rear part in the locked state. It is understood that if the front part and the rear part are not in any of the plurality of discrete, or predetermined, relative positions, the axial lock does not prevent a relative movement along the adjustment axis.

The axial lock may comprise front structures on the front part engagement portion and rear structures on the rear part engagement portion, wherein the front structures and the rear structures cooperate with one another in the locked state to prevent the movement, or relative movement, between the front part and the rear part along the adjustment axis. The front structures and rear structures may extend transversely with respect to the adjustment axis.

The front structures and rear structures may comprise one or more truncated conical pins and a plurality of cooperating conical bores, or holes, which may be truncated. The one or more truncated conical pins extend transversely to the adjustment axis, and each of the conical bores has a bore axis extending transversely to the adjustment axis. The rear structures may comprise the truncated conical pins and the front structures may comprise the conical bores. It is understood that the one or more truncated conical pins are seated in a corresponding number of conical bores in the locked state.

The axial lock may define a continuous range of relative positions between the front part and the rear part at which the locked state is possible, or at which the axial lock prevents the movement, or relative movement, between the front part and the rear part in the locked state.

The axial lock may comprise a front friction surface on the front part engagement portion and a rear friction surface on the rear part engagement portion, wherein, in the locked state, the front friction surface and the rear friction surface cooperate with, or engage, one another and prevent a movement, or relative movement, between the front part and the rear part along the adjustment axis. The friction surfaces may be smooth. It is understood that the friction between the friction surfaces is sufficiently high for preventing the relative movement when the adjustable buttstock is fitted on a firearm and the firearm is fired.

The buttstock may comprise: a slide stop defining, or setting, a front terminal position and a rear terminal position of the rear part relative to the front part along the adjustment axis. It is understood that the position of the rear part relative to the front part is limited by the slide stop. The adjustable buttstock is fully collapsed, or the rear part is fully retracted, when the rear part is in the front terminal position. The adjustable buttstock is fully expanded, or the rear part is fully extended, when the rear part is in the rear terminal position. The front terminal position and the rear terminal position may be adjustable along, or in the direction of, the adjustment axis.

The slide stop may comprise a front part protrusion extending from the front part transversely to the adjustment axis, and a rear part protrusion extending from the rear part transversely to the adjustment axis, wherein the rear part protrusion engages the front part protrusion when the rear part is in the rear terminal position relative to the front part, or when the rear part is in the front terminal position relative to the front part. The front part protrusion may extend towards the rear part, and the rear part protrusion may extend towards the front part. This means that the rear part protrusion and the front part protrusion define the rear terminal position or the front terminal position.

The rear part protrusion may be releasably attached to the rear part. Additionally, or alternatively, the front part protrusion may be releasably attached to the front part. The rear part protrusion may be a threaded bolt, and the rear part may have a plurality of cooperating threaded bores, or holes, positioned in a sequence extending parallel to the adjustment axis. Similarly, the front part protrusion may be a threaded bolt, and the front part may have a plurality of cooperating threaded bores, or holes, positioned in a sequence extending parallel to the adjustment axis.

The slide stop may comprise one or more (preferably one) front part protrusions extending from the front part transversely to the adjustment axis, and one or more (preferably two) rear part protrusion extending from the rear part transversely to the adjustment axis, wherein at least one of the rear part protrusions engages at least one of the front part protrusions when the rear part is in the rear terminal position relative to the front part, and at least one of the rear part protrusions engages at least one of the front part protrusions when the rear part is in the front terminal position relative to the front part. The one or more front part protrusions may extend towards the rear part, and the one or more rear part protrusions may extend towards the front part. If there are one front part protrusion and two rear part protrusions, the former may be positioned between the latter.

The one or more rear part protrusions may be releasably attached to the rear part. Additionally, or alternatively, the one or more front part protrusions may be releasably attached to the front part. The rear part protrusions may be threaded bolts, and the rear part may have a plurality of cooperating threaded bores, or holes, positioned in sequence in the direction of the adjustment axis. Similarly, the front part protrusions may be threaded bolts, and the front part may have a plurality of cooperating threaded bores, or holes, positioned in sequence in the direction of the adjustment axis.

The buttstock front part may comprise a receiver extension, or buffer tube. The front part joint portion may be mounted on the receiver extension. Alternatively, the receiver extension may constitute, or form, the front part joint portion and/or the front part engagement portion. In other words, the front part joint portion may be a receiver extension.

Alternatively, the front part may be configured to house, or to be attached to, the receiver extension of the firearm. For example, the receiver extension may form part of, or be compatible with, an "automatic" rifle based on the AR-10 or AR-15 platforms.

Alternatively, the adjustable buttstock may be a foldable buttstock. The front part may be configured to fold relative to the firearm, for example around an axis that is transverse to the bore axis of the firearm and extending in a vertical direction when the firearm is oriented for horizontal firing.

BRIEF DESCRIPTION OF THE DRAWINGS

Different embodiments of the proposed technology are described below. References are made to the following figures, wherein:

FIG. 12 is a vertical through-cut parallel to the adjustment axis of the embodiment shown in FIGS. 11*a-d*.

FIGS. 13*a-c* illustrate an exploded view of FIG. 12.

DETAILED DESCRIPTION

Figure 1A:
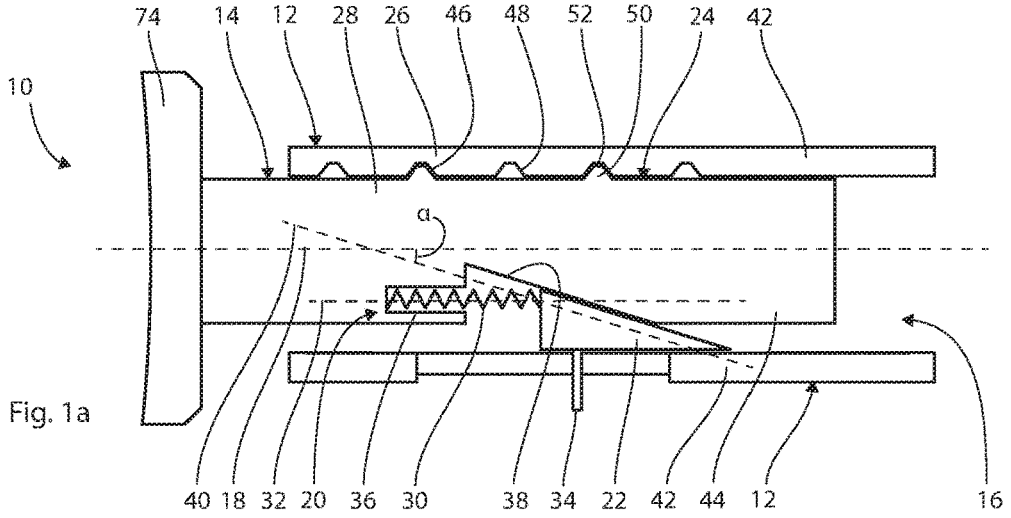
FIGS. 1*a-c* are schematic side-view through-cuts of an embodiment of the proposed buttstock having a front part joint portion enclosing a rear part joint portion.
Figure 1B:
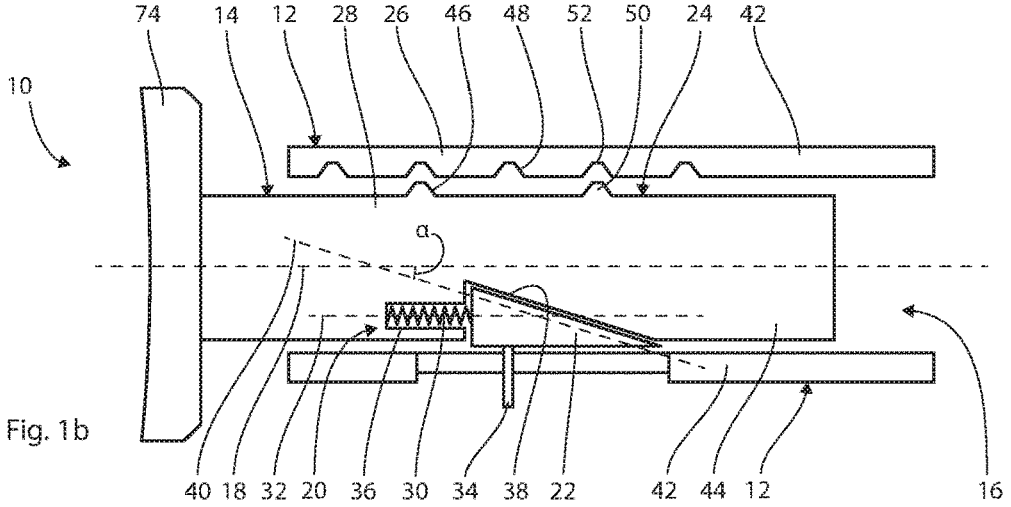
Figure 1C:
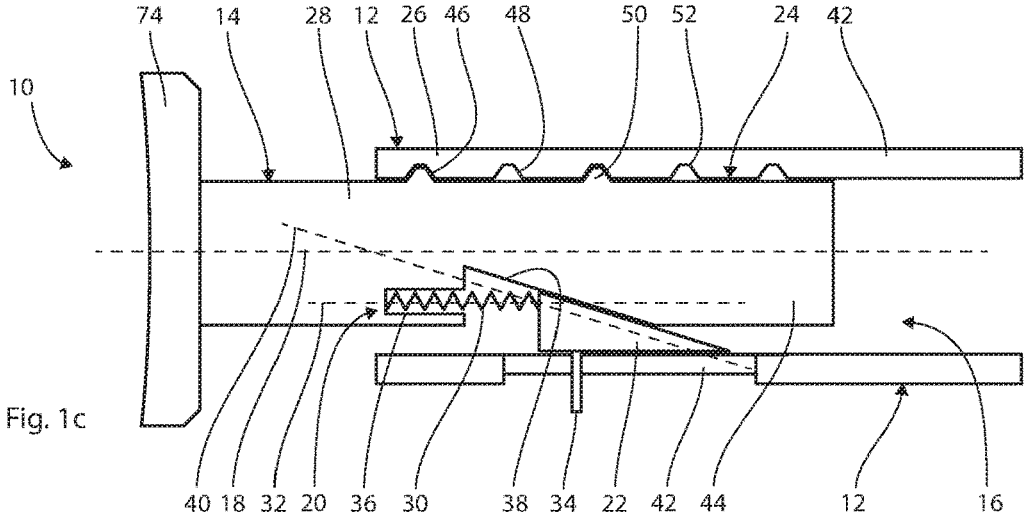

An embodiment of the proposed buttstock is shown in FIGS. 1*a-c*. The buttstock 10 is shown in the locked state in FIG. 1*a*, in unlocked state in FIG. 1*b*, and in the locked state following an extension of the buttstock 10 in FIG. 1*c*.

The buttstock 10 has front part 12 that, at its front end, can be attached to the rear end of the receiver, or chassis, of a firearm. The buttstock 10 further has a rear part 14 that is lengthwise adjustable with respect to the front part 12, and in extension with respect to the firearm. The rear part 14 typically has a shoulder pad 74 at its rear end. The front part 12 has a front part joint portion 42, and the rear part 14 has a rear part joint portion 44 that jointly forms a prismatic joint 16. The front part joint portion 42 encloses the rear part joint portion 44. The front part 12 and the rear part 14 may be machined from an aluminum alloy.

The prismatic joint 16 defines an adjustment axis 18 along which the rear part 14 can slide relative to the front part 12. When the buttstock 10 is attached to a firearm, the adjustment axis 18 is oriented in parallel with the bore axis of the firearm. The prismatic joint 16 allows for a play transverse to the adjustment axis 18 between the front part 12 and the rear part 14, as can clearly be seen in FIG. 1*b*.

The front part 12 has a front part engagement portion 26 and the rear part 14 has rear part engagement portion 28 that faces the front part engagement portion 26. The two engagement portions 26 and 28 are pressed together in the locked state, as can be seen in FIGS. 1*a* and 1*c*. The front part engagement portion 26 is located on the front part joint portion 42, and the rear part engagement portion 28 is located on the rear part joint portion 44.

There are front structures 46 on the front part engagement portion 26 and rear structures 48 on the rear part engagement portion 28. The front structures 46 and the rear structures 48 extend transversely to the adjustment axis 18 and are pressed together and cooperate with one another in the locked state, thus preventing the relative movement between the front part 12 and the rear part 14 along the adjustment axis 18. This way, the front part engagement portion 26 and the rear part engagement portion 28 form an axial lock.

The two engagement portions 26 and 28 are not pressed together in the unlocked state. The radial play between the front part 12 and the rear part 14 then allows for the front structures 46 and the rear structures 48, and in extension the front part engagement portion 26 and the rear part engagement portion 28, to disengage and separate, whereby and the rear part 14 can slide relative to the front part 12.

The front structures 46 are formed by several (e.g., five, as shown in the drawings)) truncated conical bores 52 facing the rear part 14 and extending transversely to the adjustment axis 18. The rear structures 48 are formed by truncated conical pins 50 (preferably two, as shown in the drawings) extending transversely to the adjustment axis 18. Each of the truncated conical pins 50 is seated in a conical bore 52 in the locked state, as can be seen in FIGS. 1*a* and 1*c*. This configuration allows for several (e.g., three, in the exemplary embodiment shown in the drawings) discrete and predetermined relative positions between the front part 12 and the rear part 14 in which the axial lock 24 locks them together. The axial lock 24 prevents a relative movement between the front part 12 and the rear part 14 when the adjustable buttstock is fitted on a firearm and the firearm is fired.

The adjustable buttstock 10 further has a lock assembly 20 that includes a wedge 22. The wedge 22 is depicted having a simple triangular wedge shape in FIGS. 1*a*-1*c*. In other embodiments, it can have different shapes, and it is the function of a wedge that is important for providing a radial locking function. When the lock assembly 20 and the buttstock 10 are in the locked state, the wedge 22 is releasably wedged between the front part 12 and the rear part 14 of the prismatic joint 16, thus pressing the front part engagement portion 26 and the rear part engagement portion 28 together and forming a radial lock preventing a radial play between the front part and 12 the rear part 14 with respect to the adjustment axis 18, as shown in FIGS. 1*a* and 1*c*. In the unlocked state the wedge 22 is unengaged with respect to the prismatic joint 16, allowing for the radial play between the front part 12 and the rear part 14 relative to the adjustment axis 18, as shown in FIG. 1*b*.

The wedge 22 may be fabricated (e.g., machined) from an aluminum alloy, which means that the contact surfaces between the front part 12, the rear part 14, and the wedge 22 are metal-to-metal in the prismatic joint 16.

The rear part 14 forms a wedge support 38 that houses and slidably supports the wedge 22. The wedge support 38 restricts the movement of the wedge 22 to follow a wedge axis 40, which intersects the adjustment axis 18. The lock assembly further has a helical coil spring 30, defining a spring axis 32, that pushes the wedge 22 along the wedge axis 40 and biases the wedge 22 so that the buttstock 10 is in the locked state. The spring 30 slides on the back end of the wedge 22 when the buttstock 10 changes between locked and unlocked states.

The wedge support 38 is open downward, and the wedge 22 is located at the lower end of the rear part joint portion 44. The rear part engagement portion 28 is located at the upper end of the rear part joint portion 44 directly above the wedge 22. This means that the engagement portion 28 and the wedge 22 are positioned at transversely opposing sides of the rear part joint portion 44 with respect to the adjustment axis 18, and that they have the same lengthwise position with respect to the adjustment axis 18.

The rear part 14 forms a spring support 36 that houses and supports the spring 30. The spring support 36 is connected to the wedge support 38, whereby the spring 30 can engage the wedge 22. The spring support 36 orients the spring 30 so that its helical axis 32 is parallel to the adjustment axis 18.

The adjustment axis 18, the wedge axis 40, and the helical axis 32 are in the same plane corresponding to the image plane of FIGS. 1*a*-*c*. A wedge angle ($\alpha$) is defined between the wedge axis 40 and the adjustment axis 18, and in accordance with aspects of this disclosure, may preferably be about 17°. The spring force provided by the coil spring 30 is divided into two splitting forces normal to the faces of the wedge 22. The magnitude ("strength") of the splitting forces is determined by the wedge angle ($\alpha$). The splitting forces have strong components transverse to the adjustment axis 18, and the resulting mechanical advantage with a wedge angle ($\alpha$) of about 17° would then be in the range of about 4-5.

The lock assembly 20 may have a grip 34 attached to the wedge 22 and that protrudes downwards, by which an operator can manually pull the biased wedge 22 backward and set the lock assembly 20, and in extension the buttstock 10, in the unlocked state.

As can be seen in FIGS. 1*a*-*c*, the wedge 22 is preferably oriented such that it releases the locked state if the front part 12 and the rear part 14 are pushed together along the adjustment axis 18. This also means that the wedge 22 further secures the locked state if the front part 12 and the rear part 14 are pulled apart along the adjustment axis 18.

Figure 2A:
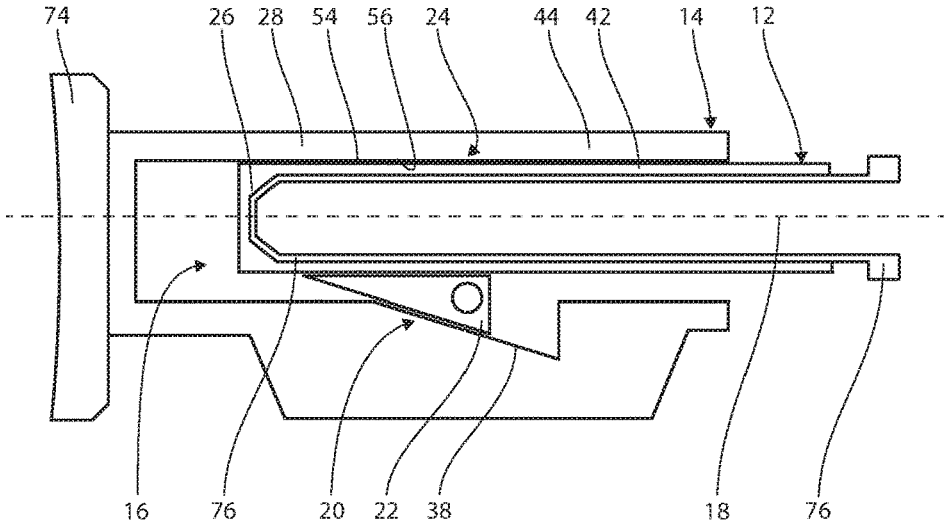
FIGS. 2*a-c* are schematic side-view through-cuts of an alternative embodiment of the proposed buttstock having a rear part joint portion enclosing a front part joint portion.
Figure 2B:
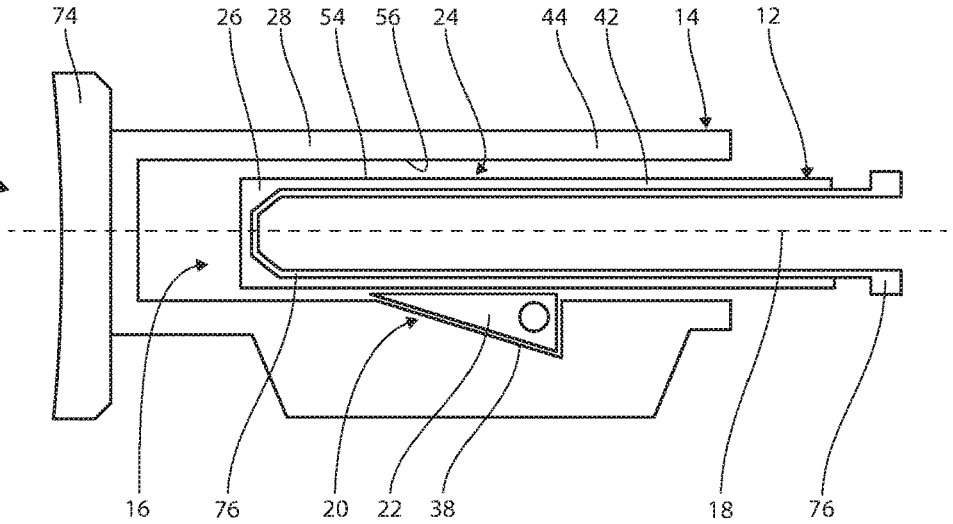
Figure 2C:
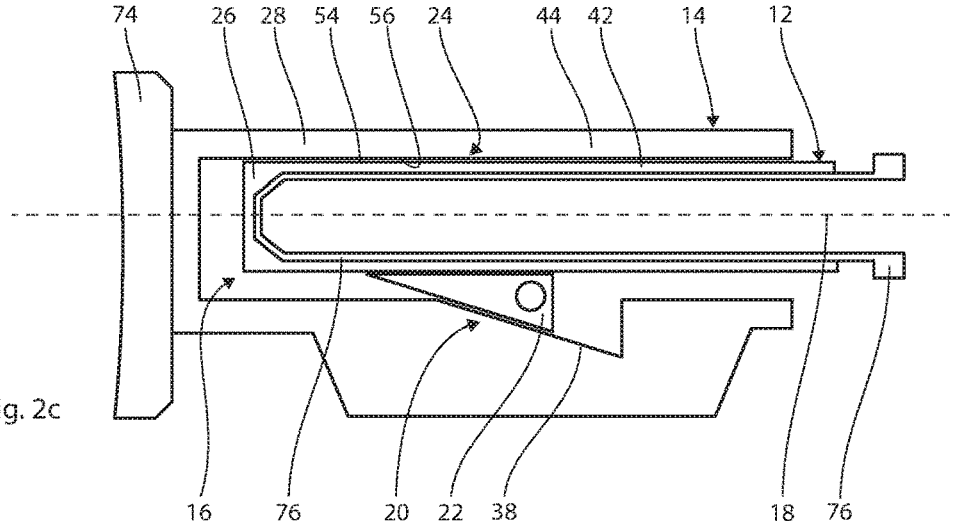

An alternative embodiment of the proposed buttstock is shown in FIGS. 2*a*-*c*. The same number indexing is used for components having the same or similar functions in FIGS. 1*a*-*c* and FIGS. 2*a*-*c*. In this embodiment, the rear part joint portion 44 encloses the front part joint portion 42. The rear part 14 forms the wedge support 38 that houses and slidably supports the wedge 22. The wedge support 38 and the wedge 22 are located below the front part 12. The wedge 22 and the front part engagement portion 26 are positioned at transversely opposing sides of the front part joint portion 42 with respect to the adjustment axis 18.

The lock assembly in accordance with this embodiment has no coil spring biasing the wedge 22. Instead, the wedge 22 can be directly accessed from the side of the rear part 14 by an operator. This means that the buttstock 10 is not biased in the locked state or in the open state, and that the locked and unlocked states of the buttstock 10 are changed by manually shifting the wedge 22.

The buttstock 10 is intended to be mounted on a firearm having a receiver extension 76, or buffer tube 76, such as on the AR-10 and AR-15 platforms. The receiver extension 76 forms part of the front part 14. The front part 14 further has the front part joint portion 42 mounted on the receiver extension 76. The front part joint portion 42 forms the front part engagement portion 26. In an alternative embodiment, the front part joint portion 42 is a receiver extension 76. In other words, the receiver extension 76 constitutes the front part joint portion 42 and forms the front part engagement portion 26.

In the alternative embodiment of FIGS. 2*a*-*c*, the front part engagement portion 26 has at its upper end a front friction surface 54, and the rear part engagement portion 26 has a rear friction surface 56 facing the front friction surface 54. In the locked state, the front friction surface 54 and the rear friction surface 56 are pressed together. The friction between them prevents a relative movement between the front part 12 and the rear part 14 along the adjustment axis 18. The fact that the axial lock 24 is formed by friction surfaces 54 and 56 means that the buttstock 10 can be set in the locked state at any relative position within a continuous range of relative positions between the front part 12 and the rear part 14.

As can be seen in FIGS. 2*a*-*c*, the wedge 22 is oriented such that it further secures the locked state if the front part 12 and the rear part 14 are pushed together along the adjustment axis 18, for example from gun recoil. This also means that the wedge 22 releases the locked state if the front part 12 and the rear part 14 are pulled apart along the adjustment axis 18.

Figure 3A:
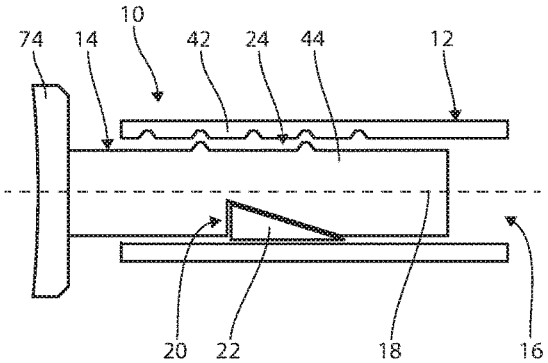
FIGS. 3*a-b* are schematic side-view through-cuts of an embodiment of the proposed buttstock having a front part joint portion enclosing a rear part joint portion and a wedge support formed by the rear part.
Figure 3B:
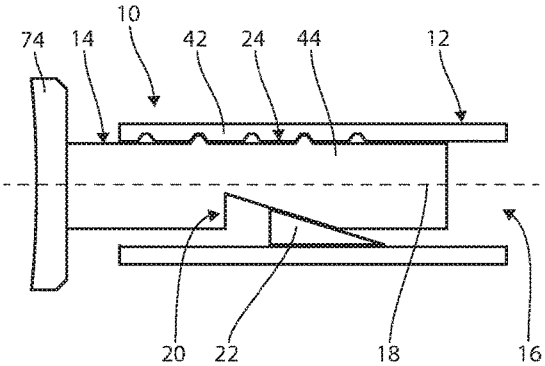
Figure 4A:
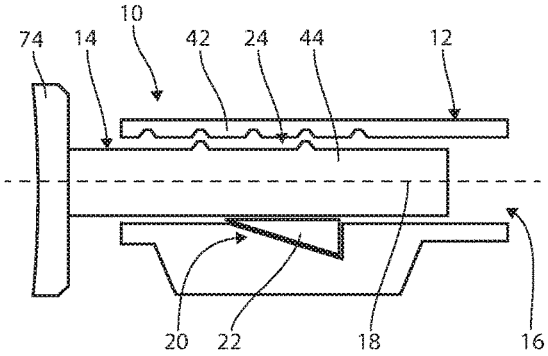
FIGS. 4*a-b* are schematic side-view through-cuts of an embodiment of the proposed buttstock having a front part joint portion enclosing a rear part joint portion and a wedge support formed by the front part.
Figure 4B:
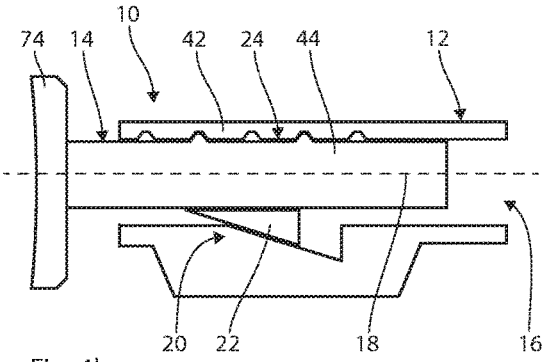
Figure 5A:
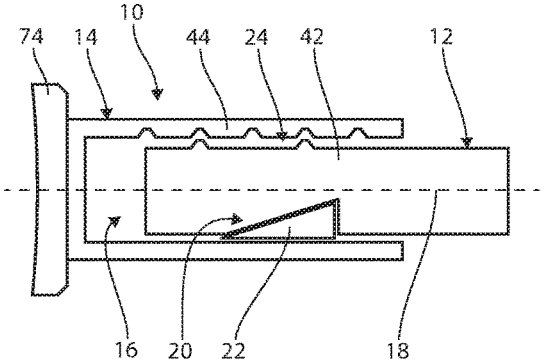
FIGS. 5*a-b* are schematic side-view through-cuts of an embodiment of the proposed buttstock having a rear part joint portion enclosing a front part joint portion and a wedge support formed by the front part.
Figure 5B:
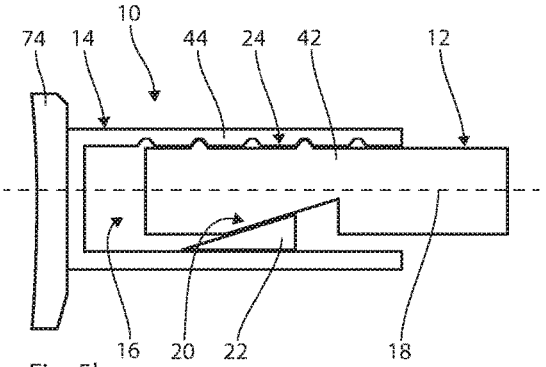
Figure 6A:
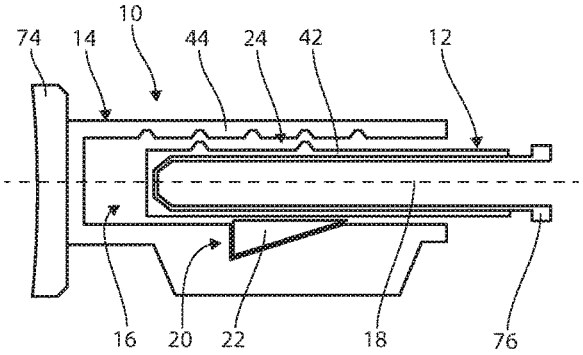
FIGS. 6*a-b* are schematic side-view through-cuts of an embodiment of the proposed buttstock having a rear part joint portion enclosing a front part joint portion and a wedge support formed by the rear part.
Figure 6B:
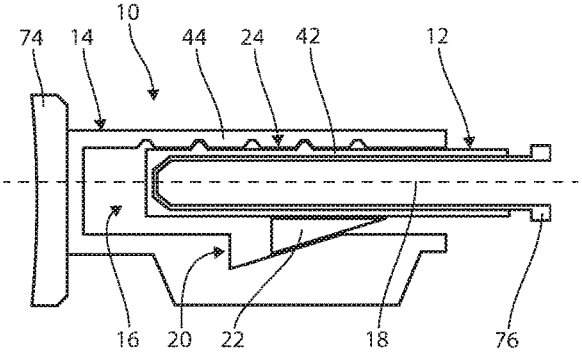
Figure 7A:
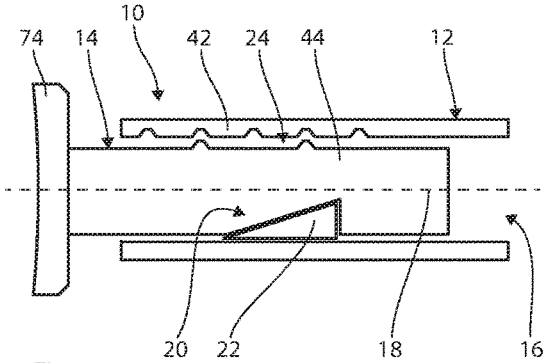
FIGS. 7*a-b* are schematic side-view through-cuts of an alternative embodiment of the proposed buttstock having a front part joint portion enclosing the rear part joint portion and a wedge support formed by the rear part.
Figure 7B:
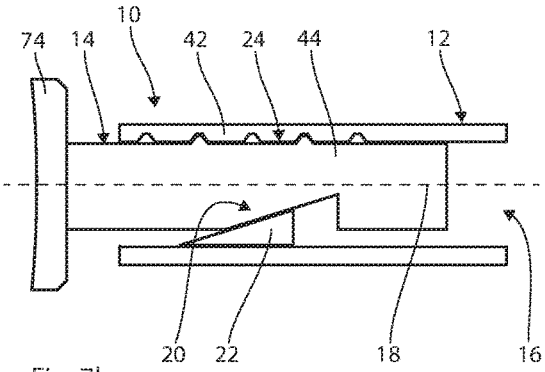
Figure 8A:
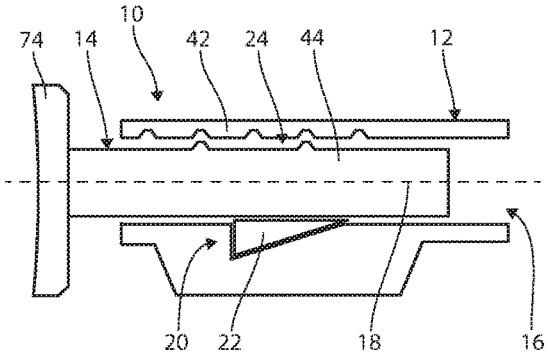
FIGS. 8*a-b* are schematic side-view through-cuts of an alternative embodiment of the proposed buttstock having a front part joint portion enclosing the rear part joint portion and a wedge support formed by the front part.
Figure 8B:
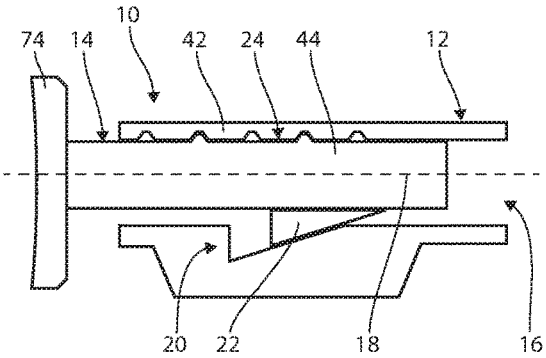
Figure 9A:
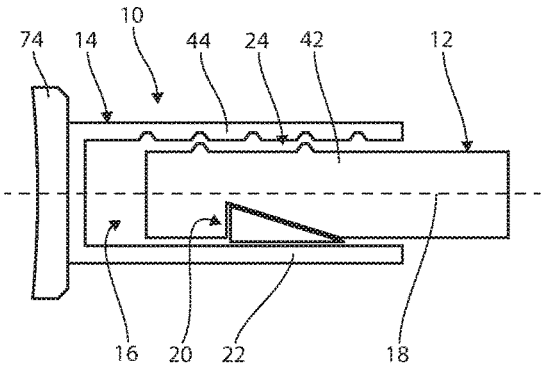
FIGS. 9*a-b* are schematic side-view through-cuts of an alternative embodiment of the proposed buttstock having a rear part joint portion enclosing the front part joint portion and a wedge support formed by the front part.
Figure 9B:
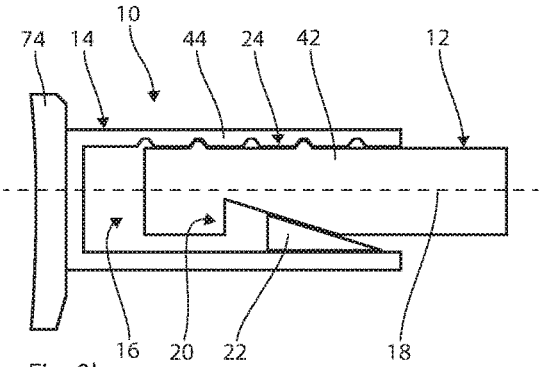
Figure 10A:
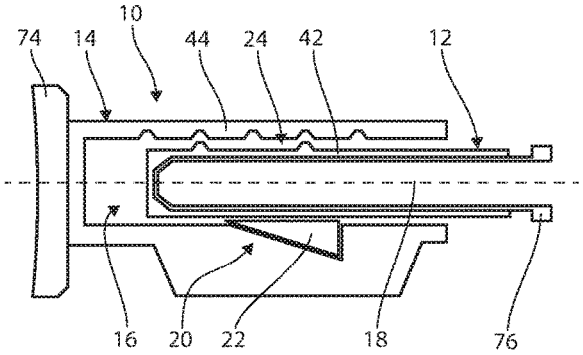
FIGS. 10*a-b* are schematic side-view through-cuts of an alternative embodiment of the proposed buttstock having a rear part joint portion enclosing the front part joint portion and a wedge support formed by the rear part.
Figure 10B:
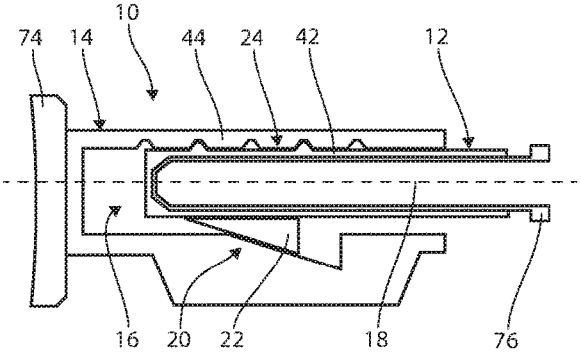

The embodiment of FIGS. 1*a*-*c* is also shown in FIGS. 3*a*-*b*. In this embodiment, the front part joint portion 42 encloses the rear part joint portion 44 and the wedge support 38 is formed by the rear part 14. Another embodiment of the proposed technology is shown in FIGS. 4*a*-*b*, in which the front part joint portion 42 encloses the rear part joint portion 44 and the wedge support 38 is formed by the front part 12. Yet another embodiment of the proposed technology is shown in FIGS. 5*a*-*b*, in which the rear part joint portion 44 encloses the front part joint portion 42, and the wedge support is formed by the front part 12. The embodiment of FIGS. 6*a-b* corresponds to the embodiment of FIGS. 2*a-c*, but with the wedge 22 in the reverse direction with its tip pointing forward and with an axial lock 24 corresponding to that of the embodiment of FIGS. 1*a-c*.

The buttstocks 10 shown in FIGS. 3 to 6 will release the wedge 22 when the front part 12 and the rear part 14 are pressed together along the adjustment axis 18.

The embodiments of the proposed technology shown in FIGS. 7*a-b* to 10*a-b* correspond to the embodiments shown in FIGS. 3*a-b* to 6*a-b*, but with the wedge 22 oriented to point in the reverse direction. This means that the wedge 22 will be further secured when the front part 12 and the rear part 14 are pressed together along the adjustment axis 18.

In FIGS. 3*a-b* to 10*a-b*, the figures denoted "a" show the buttstocks 10 in the unlocked state, and the figures denoted "b" show the buttstocks 10 in the locked state.

A detailed embodiment of a buttstock according to the proposed technology is shown in FIGS. 11*a-d* to 16*a-d*. The detailed embodiment has all the features and functions of the embodiment of FIGS. 1*a-c* and the same number indexing is used for components having the same functions in the two embodiments. The additional features of the detailed embodiment are described here.

Figure 11A:
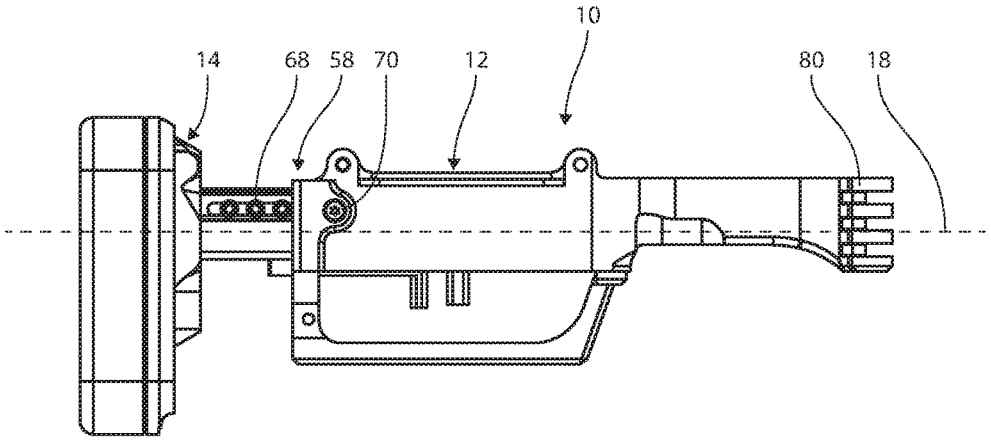
FIGS. 11*a-d* are different views of a detailed embodiment of the proposed buttstock.
Figure 11B:
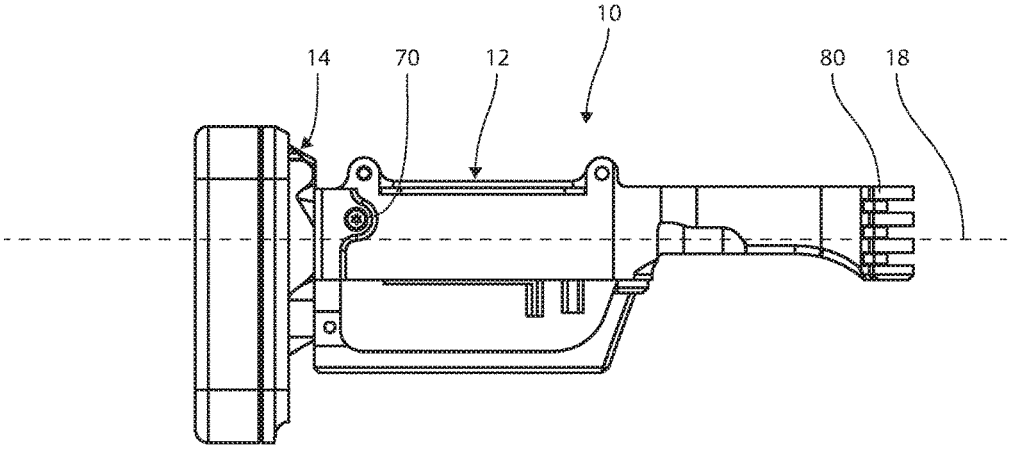
Figure 11C:
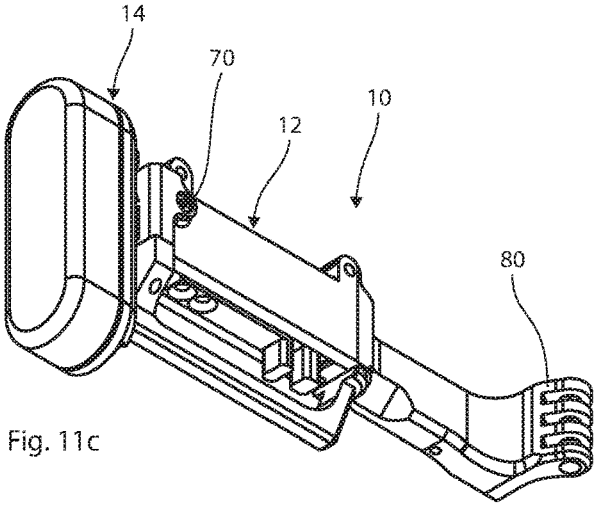
Figure 11D:
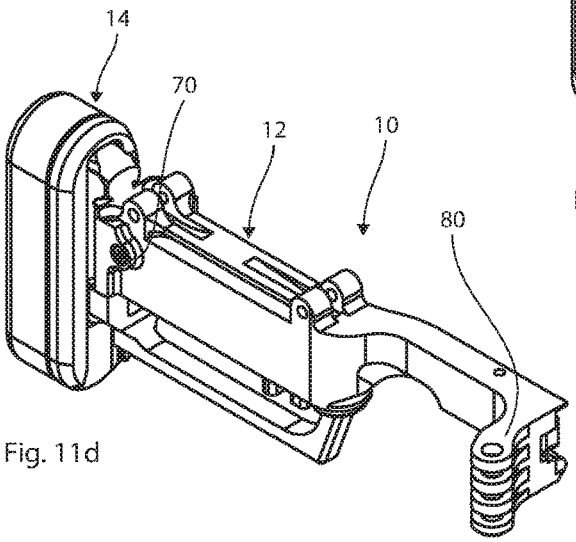
Figure 14:
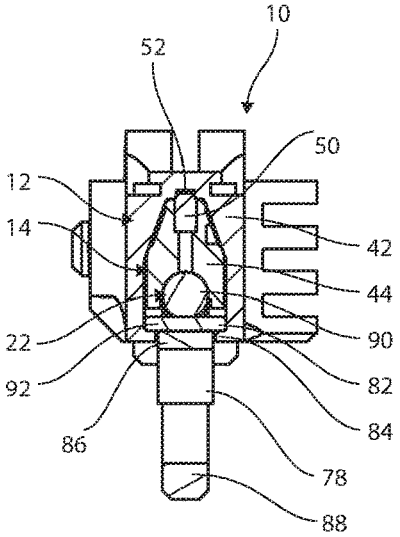
FIG. 14 is a vertical through-cut transverse to the adjustment axis of the embodiment shown in FIGS. 11*a-d*.
Figure 15A:
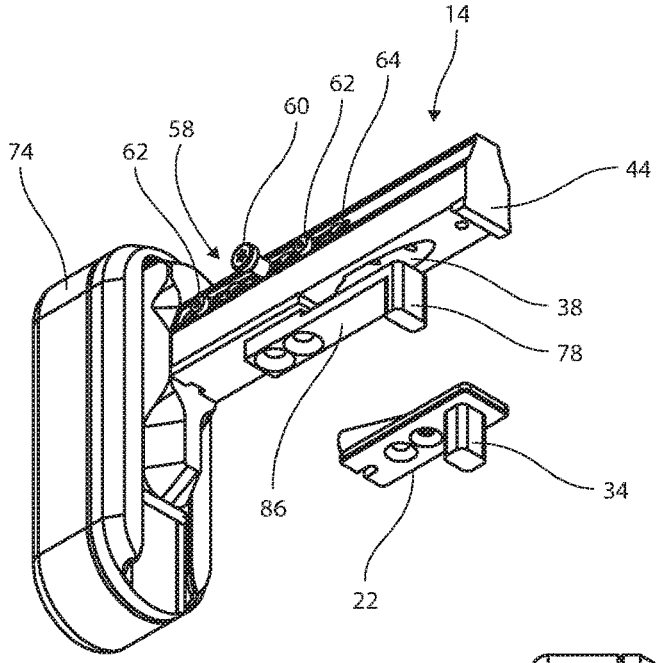
FIGS. 15*a-b* are different views of the rear part and the wedge of the embodiment shown in FIGS. 11*a-d*.
Figure 15B:
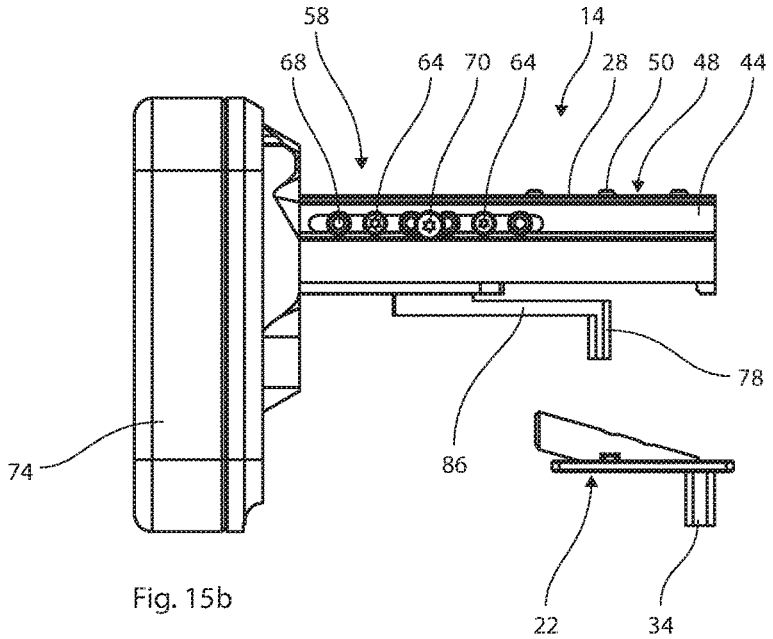
Figure 16A:
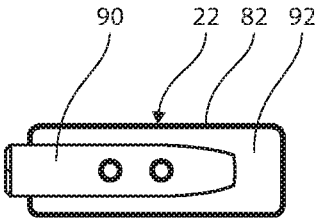
FIGS. 16*a-d* are different views of the wedge of the embodiment shown in FIGS. 11*a-d*.
Figure 16C:
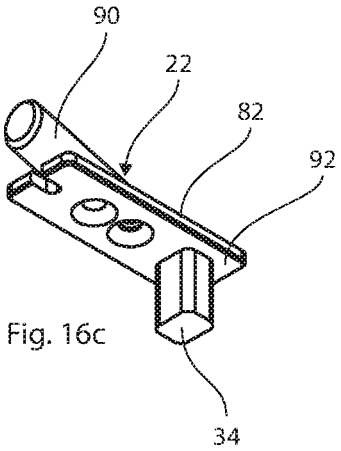
Figure 16B:
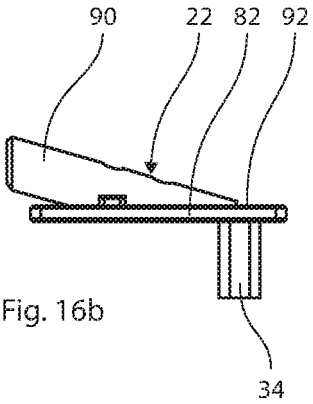
Figure 16D:
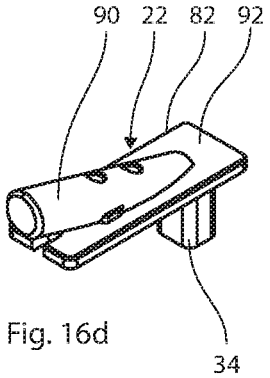

FIGS. 11*a-d* are different views of the complete buttstock 10. FIG. 11*a* shows the buttstock 10 with the rear part 14 expanded with respect to the front part 12. FIGS. 11*b-d* show the buttstock 10 with the rear part 14 fully retracted. FIG. 12 shows a lengthwise and vertical through cut of the buttstock 10, with the buttstock in the locked state. The buttstock has been reoriented by a half-turn around a vertical axis with respect to FIG. 11*b*. FIGS. 13*a-c* show a partly exploded view of FIG. 12. The coil spring 30 in FIGS. 1*a-c* has been omitted from FIGS. 12 to 13*a-c* for the sake of clarity, but it is understood that it is located in the cylindrical bore of the spring support 36, and that it biases the wedge 22 to be in the position shown in FIG. 12. FIG. 14 shows a transverse and vertical through cut of the buttstock 10 in the locked state. FIGS. 15*a-b* shows the rear part 14 and the wedge 22. FIGS. 16*a-d* show the wedge 22.

As described in relation to FIGS. 1*a-c*, the lock assembly 20 may have a first grip 34 attached to the wedge 22 that protrudes downward. The rear part 14 may have a fixed second grip 78 that also protrudes downward. When the buttstock is in the unlocked state, the rear part 14 can be shifted relative to the front part by pulling and pushing on the second grip 78 in the direction of the adjustment axis. The first grip 34 of the lock assembly 20 is in close proximity to the second grip 78, which means that both can be engaged simultaneously by the thumb and forefinger of an operator, and that the buttstock can be held in the open position while shifting the rear part 14.

The wedge axis 40 is shown in FIG. 13*c*. When the first grip 34 is pulled towards the second grip 78, the wedge 22 moves to the right and upwards in FIG. 12, following the wedge axis 40 shown in FIG. 13*a*. The rear part 14 has a wedge retainer 86 preventing the wedge 22 from leaving the wedge support 38 when the rear part 14 is completely removed from the front part 12. The second grip 78 extends from the wedge retainer 86, as can be seen in FIGS. 12 and 13*b*.

The wedge 22 has a cylindrical body 90 with planar end faces preferably at approximately a right angle to one another. It may further have a base plate 92, and one end of the cylindrical body 90 is engaged by the spring 30, while the other end is attached to the base plate 92, see FIGS. 16*a-d*. This means that the base plate 92 is at approximately a right angle to the end face engaged by the spring 30.

The base plate 92 forms outward extending wedge flanges 82 on either side of the cylindrical body 90. The rear part 14 further forms inward extending retention flanges 84 that are engaged by the wedge flanges 82 in the locked state. The retention flanges 84 are spaced apart such that the first grip 34 and the wedge retainer 86 with the second grip 78 can slide between them along the adjustment axis 18.

There is a gap between the base plate 92 and the rear part in the locked state, which can be seen in FIG. 14. This gap is reduced when the first grip 34 is pulled by an operator and the buttstock 10 is set in the unlocked state, effectively reducing the combined height of the rear part 14 and the wedge 22. In FIG. 14, the first grip 34 is located behind the second grip 78 and cannot be seen in the figure.

The buttstock 10 of the detailed embodiment is provided with a slide stop 58. The different features of the slide stop are shown in FIGS. 11*a-d*, 13*c*, and 15*a-b*. The slide stop 58 may have a front part protrusion 60 in the form of a threaded bolt 70 secured in a threaded bore 72 in the front part 12. The threaded bore 72 is preferably a through hole, and the front part protrusion 60 extends from the front part 12 transversely to the adjustment axis 18 and towards the rear part 14. The front part protrusion 60 can be manually retracted from outside the front part 12, for example by using a screwdriver. It should be noted that in FIGS. 15*a-b* the position of the front part protrusion 60 is shown without showing the supporting front part 12.

The slide stop 58 may further have rear part protrusions (preferably two) in the form of threaded bolts 64 secured in threaded bores 68. The rear part protrusions 62 extend from the rear part 16 transversely to the adjustment axis 18 and towards the front part.

When the buttstock 10 is assembled, the front part protrusion 60 is positioned between the rear part protrusions 62. When the rear part 14 is extended from the front part 12, the innermost rear part protrusion 62 will eventually engage the front part protrusion 60, effectively defining a maximum extension of the buttstock 10, or a rear terminal position. When the rear part 14 is retracted, the outermost rear part protrusion 62 will eventually engage the front part protrusion 60, effectively defining a minimum extension of the buttstock 10, or a front terminal position. This means that the position of the rear part 14 relative to the front part 12 is limited by the slide stop 58. To disassemble the buttstock 10, the front part protrusion 60 must first be retracted.

There is a sequence of, or a row of, several (preferably six) regularly spaced threaded bores 68 aligned along the adjustment axis 18; see FIG. 15*b*. The rear part protrusions 62 can be secured in any of the threaded bores 68. This means that the rear part protrusions 62 are releasably attached to the rear part 14, and that the rear terminal position and the front terminal position are adjustable along the adjustment axis 18.

The buttstock 10 may have a grip guard 88 fitted on the front part 12 to reduce the risk of the first grip 34 being accidentally engaged, and in extension the buttstock 10 from accidentally being set in the unlocked state. The front part 12 further forms a folding joint part 80 intended to mate with cooperating folding joint part at the rear end of a receiver, or chassis, of a firearm, allowing the buttstock 10 to be folded with respect to the receiver.

ITEM LIST

10 adjustable buttstock
12 front part

14 rear part
16 prismatic joint
18 adjustment axis
20 lock assembly
22 wedge
24 axial lock
26 front part engagement portion
28 rear part engagement portion
30 spring
32 helical axis
34 first grip
36 spring support
38 wedge support
40 wedge axis
42 front part joint portion
44 rear part joint portion
46 front structures
48 rear structures
50 truncated conical pins (ADD)
52 (truncated) conical bores (ADD)
54 front friction surface
56 rear friction surface
58 slide stop
60 front part protrusion
62 rear part protrusion
64 rear threaded bolt
68 rear threaded bores
70 front threaded bolt
72 front threaded bore
74 shoulder pad
76 receiver extension
78 second grip
80 folding joint part
82 wedge flanges
84 retention flanges
86 wedge retainer
88 grip guard
90 wedge cylindrical body
92 wedge base plate

The invention claimed is:

1. An adjustable buttstock for a firearm, the buttstock comprising:

a front part configured to be attached to the firearm;

a rear part forming a prismatic joint with the front part, the prismatic joint having an adjustment axis whereby the rear part is allowed to slide relative to the front part along the adjustment axis; and a lock assembly comprising a wedge;

wherein the adjustable buttstock has a locked state in which the wedge is releasably wedged between the front part and the rear part at the prismatic joint, thereby preventing a radial play between the front part and the rear part relative to the adjustment axis; and an unlocked state in which the wedge is unengaged with respect to the prismatic joint, thereby allowing for a radial play between the front part and the rear part relative to the adjustment axis.

2. The adjustable buttstock according to claim 1, wherein the wedge is configured to move along a wedge axis that is coplanar with and intersects the adjustment axis.

3. The adjustable buttstock according to claim 2, wherein the lock assembly further comprises a spring configured to push the wedge along the wedge axis.

4. The adjustable buttstock according to claim 3, wherein the spring is configured to bias the wedge to set the adjustable buttstock in the locked state.

5. The adjustable buttstock according to claim 4, wherein the lock assembly further comprises a first grip fixed to the wedge and configured for a manual setting of the adjustable buttstock in the unlocked state by an operator.

6. The adjustable buttstock according to claim 5, wherein the rear part comprises a spring support configured to support the spring, and a wedge support configured to slidably support the wedge.

7. The adjustable buttstock according to claim 5, wherein the front part comprises a wedge support configured to slidably support the wedge.

8. The adjustable buttstock according to claim 1, wherein the wedge is oriented to further secure the wedge when the front part and the rear part are pushed together along the adjustment axis in the locked state.

9. The adjustable buttstock according to claim 1, wherein the wedge is oriented to release the wedge when the front part and the rear part are pushed together along the adjustment axis in the locked state.

10. The adjustable buttstock according to claim 1, wherein the buttstock comprises an axial lock configured to prevent relative movement between the front part and the rear part along the adjustment axis in the locked state and to allow relative movement between the front part and the rear part along the adjustment axis in the unlocked state.

11. The adjustable buttstock according to claim 10, wherein the prismatic joint comprises:

a front part engagement portion on the front part; and a rear part engagement portion on the rear part and facing the front part engagement portion in the locked state;

wherein the front part engagement portion and the rear part engagement portion are pressed together in the locked state.

12. The adjustable buttstock according to claim 11, wherein the axial lock defines a plurality of discrete relative positions between the front part and the rear part at which the axial lock prevents the relative movement between the front part and the rear part in the locked state.

13. The adjustable buttstock according to claim 12, wherein the axial lock comprises front structures on the front part engagement portion, and rear structures on the rear part engagement portion, wherein the front structures and the rear structures cooperate with one another in the locked state to prevent the relative movement between the front part and the rear part along the adjustment axis.

14. The adjustable buttstock according to claim 11, wherein the axial lock defines a continuous range of relative positions between the front part and the rear part at which the axial lock prevents the relative movement between the front part and the rear part in the locked state.

15. The adjustable buttstock according to claim 14, wherein the axial lock comprises a front friction surface on the front part engagement portion and a rear friction surface on the rear part engagement portion, wherein, in the locked state, the front friction surface and the rear friction surface cooperate with one another to prevent a relative movement between the front part and the rear part along the adjustment axis.

16. The adjustable buttstock according to claim 1, wherein the buttstock further comprises:

a slide stop defining a front terminal position and a rear terminal position of the rear part relative to the front part along the adjustment axis.

17. The adjustable buttstock according to claim 16, wherein the slide stop comprises one or more front part protrusions extending from the front part transversely to the adjustment axis, one or more rear part protrusion extending from the rear part transversely to the adjustment axis, wherein at least one of the rear part protrusions engages at least one of the front part protrusions when the rear part is in the rear terminal position relative to the front part, and at least one of the rear part protrusions engages at least one of the front part protrusions when the rear part is in the front terminal position relative to the front part.

18. The adjustable buttstock according to claim 1, wherein the buttstock front part comprises a receiver extension.

19. The adjustable buttstock according to claim 1, wherein the buttstock is a foldable buttstock.

20. A firearm comprising an adjustable buttstock, comprising:

a front part configured to be attached to the firearm;

a rear part forming a prismatic joint with the front part, the prismatic joint having an adjustment axis whereby the rear part is allowed to slide relative to the front part along the adjustment axis; and a lock assembly comprising a wedge;

wherein the adjustable buttstock has a locked state in which the wedge is releasably wedged between the front part and the rear part at the prismatic joint, thereby preventing a radial play between the front part and the rear part relative to the adjustment axis; and an unlocked state in which the wedge is unengaged with respect to the prismatic joint, thereby allowing for a radial play between the front part and the rear part relative to the adjustment axis.

* * * * *